US005243952A

United States Patent [19]

Ikuta et al.

[11] Patent Number: 5,243,952

[45] Date of Patent: Sep. 14, 1993

[54] AIR-FUEL RATIO CONTROL APPARATUS FOR USE IN ENGINE

[75] Inventors: Kenji Ikuta, Hekinan; Syohei Udo, Kawasaki; Toshio Kondo, Kariya, all of Japan

[73] Assignee: Nippondenso Co., Ltd., Kariya, Japan

[21] Appl. No.: 804,662

[22] Filed: Dec. 10, 1991

[30] Foreign Application Priority Data

Dec. 10, 1990 [JP] Japan ..... 2-401060

[51] Int. Cl.[5] ..... F02D 41/14

[52] U.S. Cl. ..... 123/682; 123/695

[58] Field of Search ..... 123/682, 687, 493, 695

[56] References Cited

U.S. PATENT DOCUMENTS

| | | | |
|---|---|---|---|
| 4,241,710 | 12/1980 | Peterson, Jr. et al. | 123/682 |
| 4,270,503 | 6/1981 | Pomerantz | 123/438 |
| 4,466,411 | 8/1984 | Hasegawa et al. | 123/480 |
| 4,489,696 | 12/1984 | Kobayashi et al. | 123/493 |
| 4,561,403 | 12/1985 | Oyama et al. | 123/682 |
| 4,628,883 | 12/1986 | Kataoka | 123/682 |

FOREIGN PATENT DOCUMENTS

| | | |
|---|---|---|
| 59-7751 | 1/1984 | Japan . |
| 1-110853 | 4/1989 | Japan . |

*Primary Examiner*—Andrew M. Dolinar

*Attorney, Agent, or Firm*—Cushman, Darby & Cushman

[57] ABSTRACT

An air-fuel ratio control apparatus for an internal combustion engine which is equipped with an air-fuel ratio sensor for sensing an actual air-fuel ratio of a mixture to be introduced into the engine and a target air-fuel ratio setting section for setting a target air-fuel ratio of the engine. Also included is a controlled-amount calculating section for setting an optimal feedback gain on the basis of a predetermined dynamic model of the engine to calculate a controlled amount in accordance with the predetermined optimal feedback gain so that the actual air-fuel ratio becomes equal to the target air-fuel ratio. A fuel supply amount to the engine is determined on the basis of the calculated controlled amount, and the control responsiveness of the controlled-amount calculating section is suppressed when the engine is in a speed-decreasing state. This arrangement can adequately control the air-fuel ratio of the engine irrespective of the engine speed-decreasing state.

5 Claims, 6 Drawing Sheets

AIR-FUEL RATIO CONTROL APPARATUS FOR USE IN ENGINE

BACKGROUND OF THE INVENTION

The present invention relates to an engine air-fuel ratio control apparatus for controlling a fuel injection amount so that an air-fuel ratio of an air-fuel mixture to be supplied to an internal combustion engine becomes equal to a theoretical air-fuel ratio.

Under the so-called modern control theory, such an air-fuel ratio control apparatus is arranged to construct a dynamic model of a system for controling the air-fuel ratio in an engine by approximating an auto-regressive model whose model order is 1 and includes a dead-time P (P=0, 1, 2, . . . ) concurrently with taking into account the disturbance, thereby determining an air-fuel ratio control amount in accordance with a state variable quantity and an optimal feedback gain predetermined on the basis of the constructed dynamic model. The optimal feedback gain is determined so that responsiveness and stability are compatible with each other in various operating conditions as disclosed in the Japanese Patent Provisional Publication No. 1-110853. There is a problem which arises with the air-fuel ratio control apparatus based upon the modern control theory, however, in that at the time of speed-reduction which causes the intake pipe pressure to considerably lower, the combustion becomes unstable due to decrease in the flaming speed so as to take a slight misfire state whereby the air-fuel ratio varies. In this case, the air-fuel ratio control apparatus tends to be quickly responsive to the air-fuel ratio variation, whereby the air-fuel ratio correction coefficient FAF greatly varies to result in promoting the air-fuel ratio variation to deteriorate the controllability at the time of the speed-reduction (see FIG. 6).

SUMMARY OF THE INVENTION

It is therefore an object of the present invention to provide an engine air-fuel ratio control apparatus which is capable of adequately controlling the air-fuel ratio by preventing the promotion of the air-fuel ratio variation during the time of the speed reduction.

In accordance with the present invention, there is provided an air-fuel ratio control apparatus for an internal combustion engine, comprising: air-fuel ratio detecting means for detecting an actual air-fuel ratio of a mixture to be introduced into the engine; target air-fuel ratio setting means for setting a target air-fuel ratio of the engine; controlled-amount calculating means for setting an optimal feedback gain on the basis of a predetermined dynamic model of the engine, and for calculating a controlled amount in accordance with the set optimal feedback gain so that the actual air-fuel ratio becomes equal to the target air-fuel ratio; fuel supply amount determining means for determining a fuel supply amount to the engine on the basis of the calculated controlled amount; speed-decreasing state detecting means for detecting a speed-decreasing state of the engine; and control suppressing means for suppressing a control responsiveness of the controlled-amount calculating means in response to detection of the speed-decreasing state of the engine.

Preferably, the fuel supply amount determining means determines the fuel supply amount on the basis of a basic supply amount of fuel to be supplied to the engine and the controlled amount calculated by the controlled-amount calculating means, and the control suppressing means includes feedback gain switching means for switching the optimal feedback gain to a feedback gain with a low responsiveness. More preferably, the control suppressing means includes control switching means for switching the control operation due to the controlled-amount calculating means to a proportional-plus-integral control operation, and the control apparatus further comprises a target air-fuel ratio switching means for switching the target air-fuel ratio to a lean side with respect to a theoretical air-fuel ratio.

According to the present invention, there is further provided an air-fuel ratio control apparatus for an internal combustion engine, comprising: air-fuel ratio detecting means for detecting an actual air-fuel ratio of a mixture to be introduced into the engine; target air-fuel ratio setting means for setting a target air-fuel ratio of the engine; first correction coefficient calculating means for setting a first optimal feedback gain on the basis of a predetermined dynamic model of the engine, and for calculating an air-fuel ratio correction coefficient in accordance with the set optimal feedback gain so that the actual air-fuel ratio becomes equal to the target air-fuel ratio; speed-decreasing state detecting means for detecting a speed-decreasing state of the engine; second correction coefficient calculating means for determining a second optimal feedback gain having a responsiveness lower than that of the first optimal feedback gain on the basis of the predetermined dynamic model in response to detection of the engine speed-decreasing state, and for calculating an air-fuel ratio correction coefficient in accordance with the determined second optimal feedback gain so that the actual air-fuel ratio becomes equal to the target air-fuel ratio; and fuel supply amount determining means for determining a fuel supply amount to the engine on the basis of the air-fuel correction coefficient calculated by the first or second correction coefficient calculating means.

In addition, according to this invention, there is provided an air-fuel ratio control apparatus for an internal combustion engine, comprising: air-fuel ratio detecting means for detecting an actual air-fuel ratio of a mixture to be introduced into the engine; target air-fuel ratio setting means for setting a target air-fuel ratio of the engine; first correction coefficient calculating means for setting a first optimal feedback gain on the basis of a predetermined dynamic model of the engine, and for calculating an air-fuel ratio correction coefficient in accordance with the set optimal feedback gain so that the actual air-fuel ratio becomes equal to the target air-fuel ratio; speed-decreasing state detecting means for detecting a speed-decreasing state of the engine; second correction coefficient calculating means for calculating an air-fuel ratio correction coefficient under a proportional-plus-integral control in response to detection of the engine speed-decreasing state so that the actual air-fuel ratio becomes equal to the target air-fuel ratio; and fuel supply amount determining means for determining a fuel supply amount to the engine on the basis of the air-fuel correction coefficient calculated by the first or second correction coefficient calculating means.

That is, at the normal time, for attaching importance to the responsibility, the air-fuel ratio is controlled in accordance with a first optimal feedback gain predetermined on the basis of a dynamic model. On the other hand, at the engine speed decreasing time, the air-fuel ratio control is controlled in accordance with a second optimal feedback gain having a responsiveness lower than that of the first optimal feedback gain, or the air-fuel ratio control is switched from the modern control to the proportional-plus-integral control. Thus, it is possible to stably control the air-fuel ratio to the target air-fuel ratio irrespective variation of the air-fuel ratio due to misfire possible in the engine speed-decreasing state.

BRIEF DESCRIPTION OF THE DRAWINGS

The object and features of the present invention will become more readily apparent from the following detailed description of the preferred embodiments taken in conjunction with the accompanying drawings in which.

DETAILED DESCRIPTION OF THE INVENTION

Figure 1:
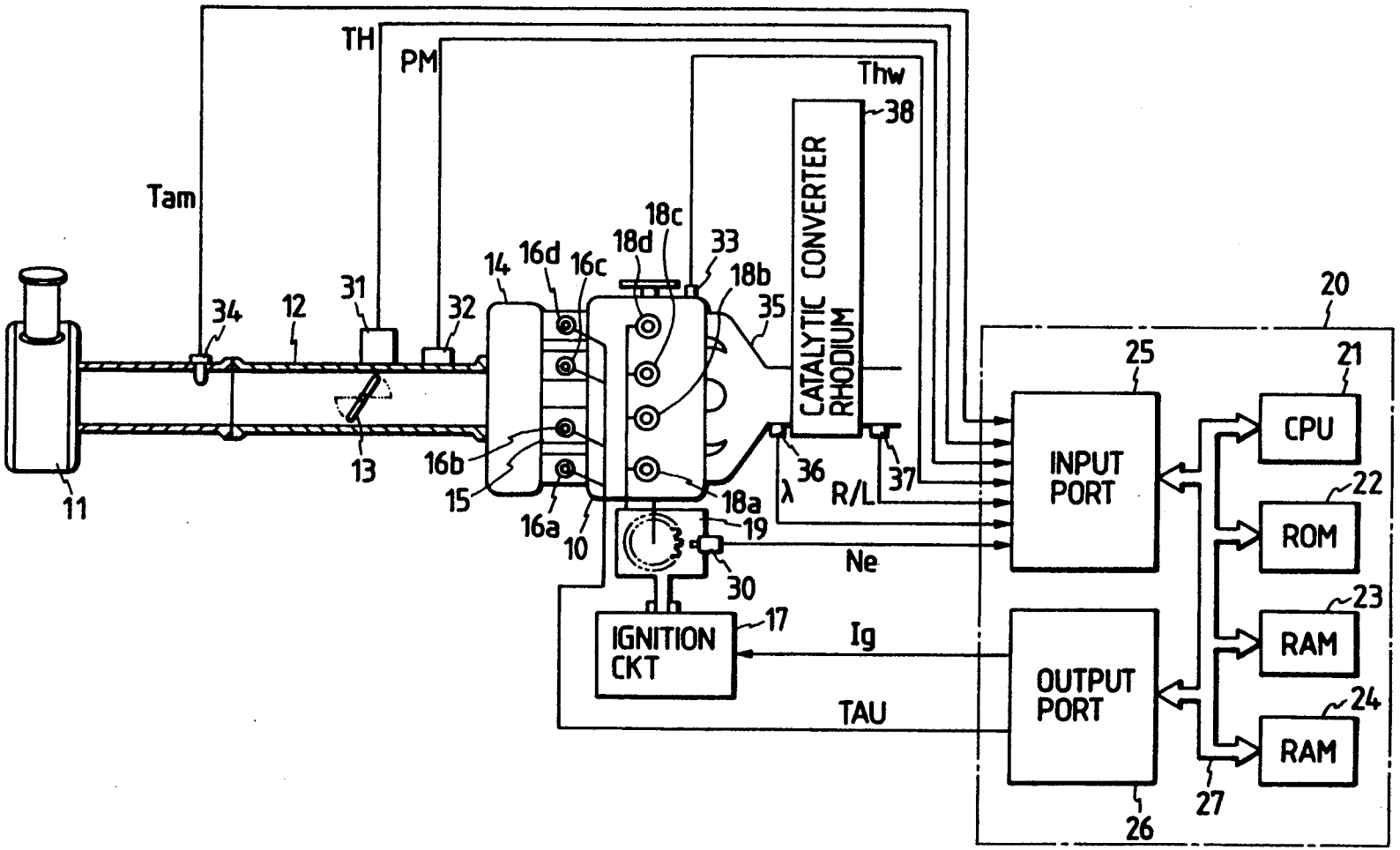
FIG. 1 is a block diagram showing the entire arrangement of an air-fuel control apparatus according to a first embodiment of the present invention.

Referring now to FIG. 1, there is illustrated an air-fuel ratio control apparatus according to an embodiment of the present invention which is applied to an engine illustrated at numeral 10. In FIG. 1, the engine 10 is of the four-cylinder four-cycle spark ignition type, and intake air is introduced from the upstream side through an air cleaner 11, an intake pipe 12, a throttle valve 13, a surge tank 14 and an intake branch pipe assembly 15 into the respective engine cylinders. On the other hand, fuel is supplied from a fuel tank (not shown) under pressure so as to be injected and supplied thereinto from fuel injection valves 16*a*, 16*b*, 16*c* and 16*d* provided in the intake branch pipe assembly 15. Further, in the engine 10, there are provided a distributor 19 for distributing a high-voltage electric signal from an ignition circuit 17 to ignition plugs 18*a*, 18*b*, 18*c* and 18*d* in the respective cylinders, a rotational speed sensor 30 provided in the distributor 19 for sensing the rotational speed Ne of the engine 10, a throttle sensor 31 for sensing the opening degree TH of the throttle valve 13, an intake pressure sensor 32 for sensing the intake pressure PM at the downstream side of the throttle valve 13, a water temperature sensor 33 for sensing the temperature Thw of the cooling water for the engine 10, and an intake air temperature sensor 34 for sensing the intake air temperature Tam. The aforementioned rotational speed sensor 30 is disposed to be in opposed relation to a ring gear rotatable in synchronism with a crank shaft of the engine 10, thereby outputting a pulse signal comprising 24 pulses at every two revolutions of the engine 10, i.e., at every 720° CA, in proportion to the rotational speed Ne. The throttle sensor 31 generates an analog signal corresponding to the throttle opening degree TH and further generates an ON-OFF signal from an idle switch for detecting the fact that the throttle valve 13 substantially enters into the full-closing state.

Further, in an exhaust pipe of the engine 10 there is provided a catalytic converter rhodium 38 for reducing hazardous components (such as CO, HC, NOx) of the exhaust gas discharged from the engine 10. At the upstream side of the catalytic converter rhodium 38 there is provided an air-fuel ratio sensor 36 which is a first oxygen concentration sensor for outputting a linear detection signal corresponding to the air-fuel ratio λ of the air-fuel mixture supplied into the engine 10, and at the downstream side thereof there is provided an $O_2$ sensor 37 which is a second oxygen concentration sensor for outputting a detection signal indicative of whether the air-fuel ratio λ of the air-fuel mixture supplied into the engine 10 takes the rich or lean state with respect to the theoretical air-fuel ratio $\lambda_O$.

An electronic control unit 20 is constructed as an arithmetic and logic unit basically including a well-known CPU 21, ROM 22, RAM 23, backup RAM 24 and others which are coupled through a bus 27 to an input port 25 for inputting the output signals of the above-described sensors and further to an output port 26 for outputting control signals to actuators. The electronic control unit 20 inputs the intake pressure PM, intake air temperature Tam, throttle opening degree TH, cooling water temperature Thw, air-fuel ratio λ, rotational speed Ne and others through the input port 25 and calculates a fuel injection amount TAU and an ignition timing 1*g* on the basis of the input data and further output control signals through the output port 26 to the fuel injection valves 16*a* to 16*d* and the ignition circuit 17, respectively.

A description will be made hereinbelow in terms of the air-fuel ratio control. The electronic control unit 20 is previously designed on the basis of the following technique in order to perform the air-fuel ratio control. This design technique is disclosed in the Japanese Patent Provisional Publication No. 1-110853.

1) Modeling of Controlled Object

In the present embodiment, an auto-regressive moving-average model whose model order is 1 and has a dead-time p (P=3) is used for the model of the system for controlling the air-fuel ratio λ and the approximation is made taking into account a disturbance d. First, the model of the system using the auto-regressive moving-average model to control the air-fuel ratio λ can be approximated as follows.

$$\lambda(k)=a\cdot\lambda(k-1)+b\cdot FAF(k-3) \quad (1)$$

where λ represents the air-fuel ratio, FAF designates an air-fuel ratio correction coefficient, a, b are constants, and k denotes a variable indicating the number of times of control after the initial sampling start.

Further, if taking into account the disturbance d, the model of the control system can be approximated as follows.

$$\lambda(k)=a\cdot\lambda(k-1)+b\cdot FAF(k-3)+d(k-1) \quad (2)$$

With respect to the model thus approximated, it is easy to perform the discretization with the rotational period (360° CA) sampling by using the step response to determine the constants a and b, that is, to obtain the transfer function G of the system of controlling the air-fuel ratio λ.

2) Method of Indicating State Variable Quantity IX (IX indicates vector quantity)

The above equation (2) becomes as follows if rewritten using the state variable IX (k) = [$X_1$(k), $X_2$(k), $X_3$(k), $X_4$(k)]$^T$ (where T designates the transpose matrix):

$$\begin{pmatrix} X_1(K+1) \\ X_2(K+1) \\ X_3(K+1) \\ X_4(K+1) \end{pmatrix} = \begin{pmatrix} ab00 \\ 0010 \\ 0001 \\ 0000 \end{pmatrix} \begin{pmatrix} X_1(K) \\ X_2(K) \\ X_3(K) \\ X_4(K) \end{pmatrix} + \begin{pmatrix} 0 \\ 0 \\ 0 \\ 1 \end{pmatrix} FAF(K) + \begin{pmatrix} 0 \\ 0 \\ 0 \\ 1 \end{pmatrix} d(K) \quad (4)$$

$$\begin{aligned} X_1(K+1) &= aX_1(K) + bX_2(K) + d(K) = \lambda(K+1) \\ X_2(K+1) &= FAF(K-2) \\ X_3(K+1) &= FAF(K-1) \\ X_4(K+1) &= FAF(K) \end{aligned} \quad (5)$$

3) Design of Regulator

In the case of designing the regulator in terms of the above-mentioned equations (3) and (4), the optimal feedback gain IK (where IK is a vector quantity) becomes as follows: by using IK = [$K_1$, $K_2$, $K_3$, $K_4$] and state variable quantity $$IX^T(k) = [\lambda(k), FAF(k-3), FAF(k-2), FAF(k-1)] \quad (6)$$

$$FAF(k) = IK \cdot IX^T(k) = K_1 \cdot \lambda(k) + K_2 \cdot FAF(k-3) + K_3 \cdot FAF(k-2) + K_4 \cdot FAF(k-1) \quad (7)$$

Further, an integral term $Z_1$(k) is added as follows in order to absorb the error:

$$FAF(k) = K_1 \cdot \lambda(k) + K_2 \cdot FAF(k-3) + K_3 \cdot FAF(k-2) + K_4 \cdot FAF(k-1) + Z_1(k) \quad (8)$$

Thus, it is possible to obtain the air-fuel ratio λ and the correction coefficient FAF.

Here, the integral term $Z_1$(k) is determined on the basis of the deviation between a target air-fuel ratio $\lambda_{TG}$ and the actual air-fuel ratio λ(k) and an integral constant Ka in accordance with the following equation:

$$Z_1(k) = Z_1(k-1) + Ka \cdot (\lambda_{TG} - \lambda(k)) \quad (9)$$

Figure 2:
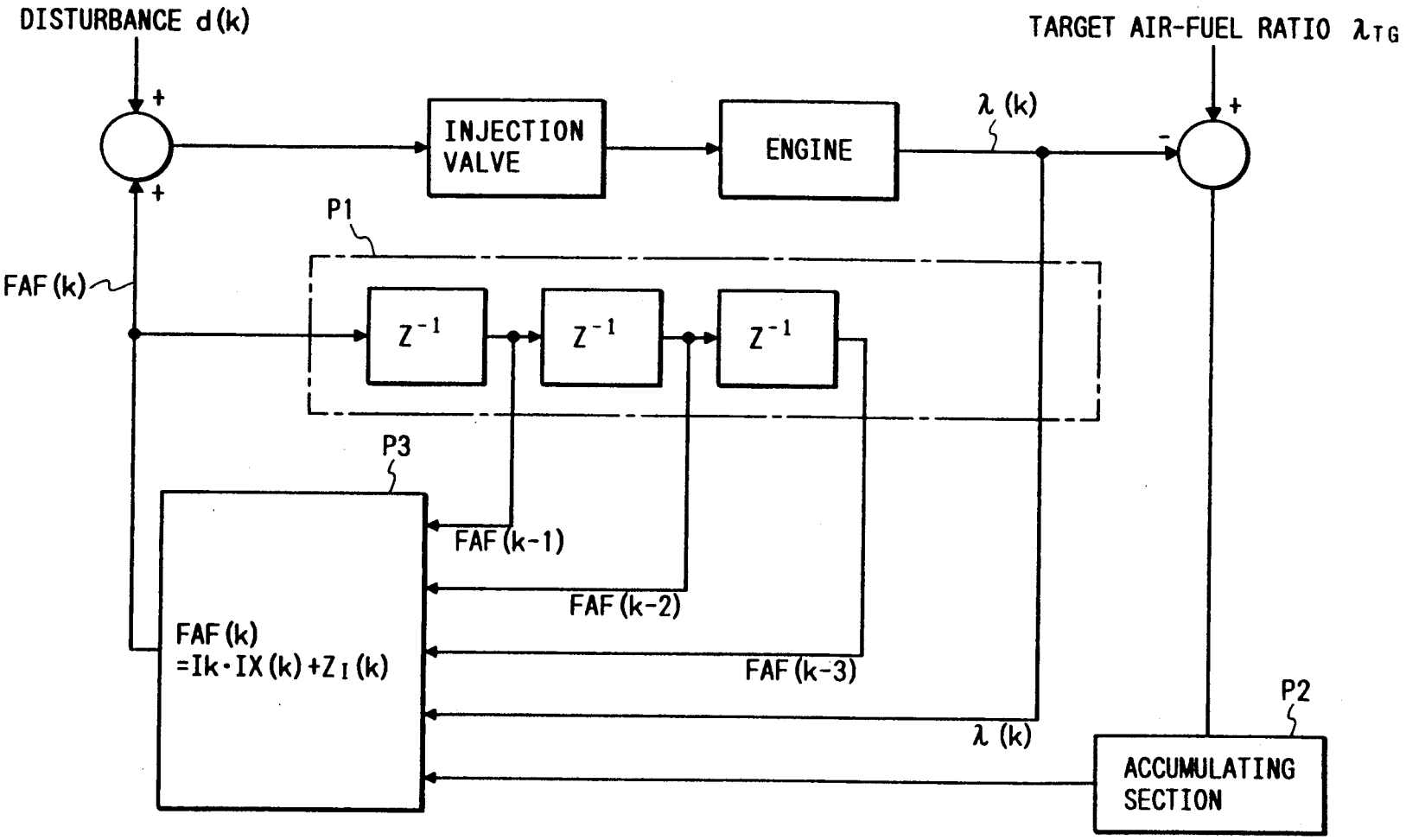
FIG. 2 is a block diagram showing the air-fuel ratio control in this invention.

FIG. 2 is a block diagram of the aforementioned model-designed system of controlling the air-fuel ratio λ. In FIG. 2, the indication is made using the $Z^{-1}$ transformation in order to derive the air-fuel ratio correction coefficient FAF(k) from FAF(k−1), while the past air-fuel ratio correction coefficient FAF(k−1) is in advance stored in the RAM 23 and read out at the next control timing. Further, in FIG. 2, a block P1 surrounded by a dashed line designates a section for determining the state variable quantity IX(k) in the state that the air-fuel ratio λ is feedback-controlled to the target air-fuel ratio $\lambda_{TG}$, a block P2 denotes a section (accumulating section) for obtaining the integral term $Z_1$(k), and a block P3 depicts a section for calculating the present air-fuel ratio correction coefficient FAF(k) on the basis of the state variable quantity IX(k) determined in the block P1 and the integral term $Z_1$(k) obtained in the block P2.

4) Determination of Optimal Feedback Gain IK and Integral Constant Ka

For example, the optimal feedback gain IK and the integral constant Ka can be set by minimizing the performance function J as indicated by the following equation:

$$J = \Sigma\{Q(\lambda(k) - \lambda_{TG})^2 + R(FAF(k) - FAF(k-1))^2\}(k=0 \text{ to } CO) \quad (10)$$

Here, the performance function J is for restricting the variation of the air-fuel ratio correction coefficient FAF(k) to minimize the deviation between the air-fuel ratio λ(k) and the target air-fuel ratio $\lambda_{TG}$, and weighting of the restriction with respect to the air-fuel ratio correction coefficient FAF(k) can be changed in accordance with the values of the weighting parameters Q and R. Accordingly, simulation may be repeatedly performed by changing the values of the weighting parameters Q and R until the optimal control characteristic can be obtained, thereby determining the optimal feedback gain IK and the integral constant Ka.

Further, the optimal feedback gain IK and the integral constant Ka depend upon the model constants a and b. Thus, for ensuring the system stability (robust) in opposition to the variation (parameter variation) of the system for controlling the actual air-fuel ratio λ, the optimal feedback gain IK and the integral constant Ka are required to be designed by making an estimation of the variations of the model constants a and b. Therefore, the simulation is effected by incorporating the actually possible variations of the model constants a and b, thereby determining the optimal feedback gain IK and integral constant Ka which can satisfy the stability.

Although the description has been made hereinabove in terms of 1) modeling of the controlled object, 2) indication method of the state variable quantity, 3) design of the regulator and 4) determination of the optimal feedback gain and the integral constant, these are predetermined and the electronic control unit 20 performs the control on the basis of the results, i.e., in accordance with the above-described equations (7) and (8).

Figure 3:
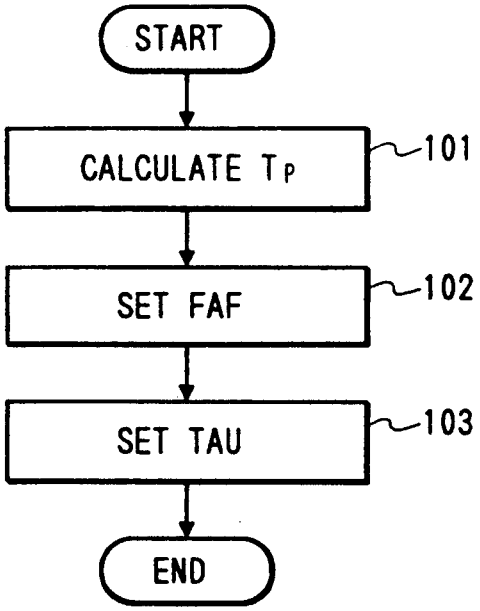
FIG. 3 is a flow chart for describing the air-fuel ratio control operation to be executed in this invention.

A description will be made hereinbelow with reference to the flow charts of FIGS. 3 and 4 in terms of the air-fuel ratio control. FIG. 3 shows an operation for setting a fuel injection amount TAU which is performed in synchronism with the rotation (at every 360° CA). In FIG. 3, the operation starts with a step 101 to calculate a basic fuel injection amount Tp in accordance with the intake pressure PM, rotational speed Ne and others. A step 102 follows to set the air-fuel ratio correction coefficient FAF so that the air-fuel ratio λ becomes equal to the target air-fuel ratio $\lambda_{TG}$ as will hereinafter be described in detail. Further, in a step 103, the basic fuel injection amount Tp is corrected on the basis of the air-fuel correction coefficient FAF and the other correction coefficient FALL in accordance with the following equation so as to set a fuel injection amount TAU.

$$TAU = FAF \times Tp \times FALL \quad (11)$$

Operation signals corresponding to the fuel injection amount TAU thus set are output to the fuel injection valves 16*a* to 16*b*.

Figure 4:
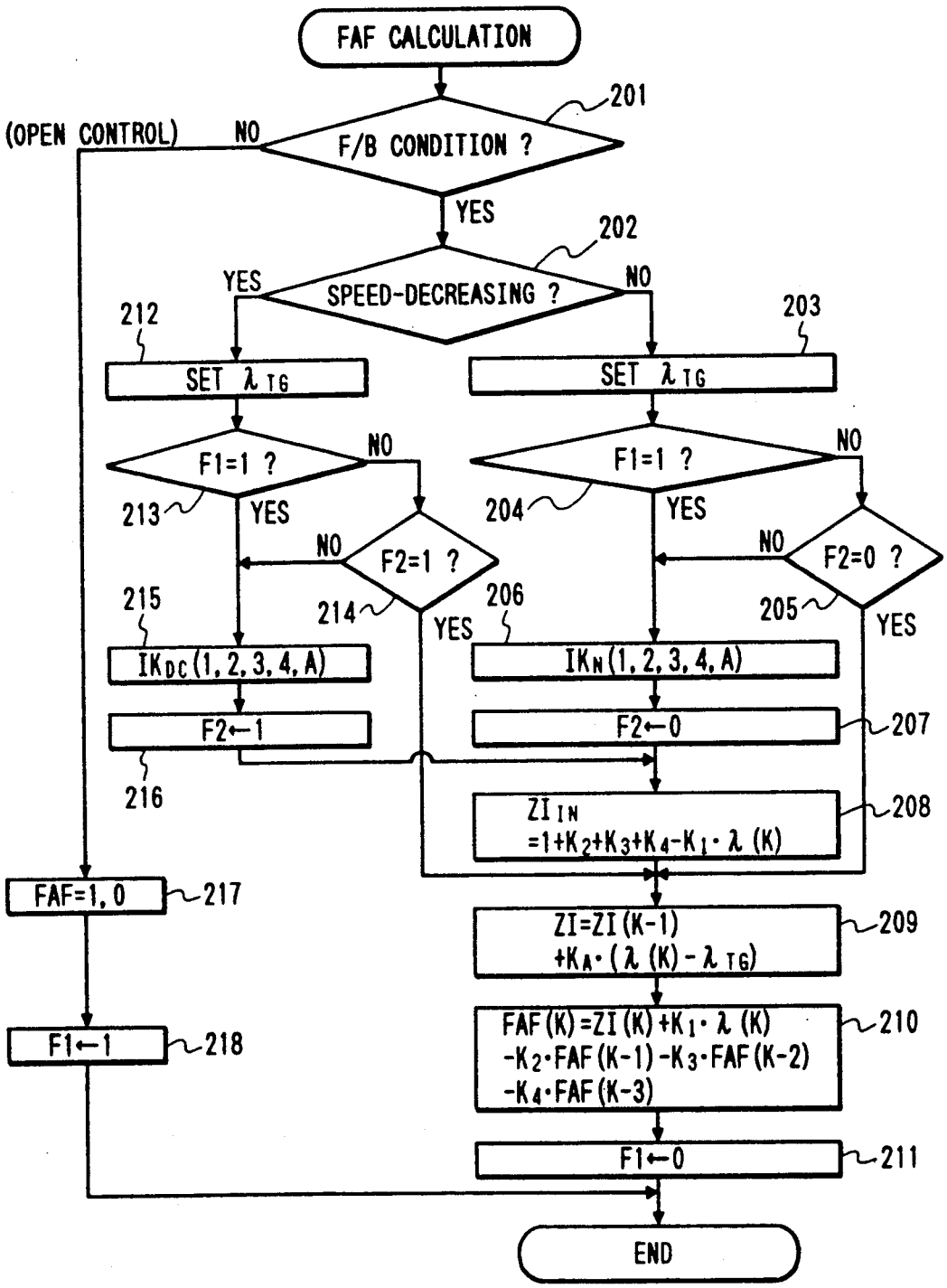
FIG. 4 is a flow chart for describing the air-fuel ratio correction calculation in the first embodiment of this invention.

In FIG. 4, a step 201 is provided in order to check whether the feedback condition of the air-fuel ratio λ is satisfied. Here, as well known, the feedback condition means that the cooling water temperature Thw is above a predetermined value, the load is not high, the rotational speed is not high, etc. When the feedback condition is not satisfied, a step 217 follows to set the air-fuel ratio correction coefficient FAF to "1", then followed by a step 218 to set an open control decision flag F1 to "1" whereby the feedback control is not effected but the fuel injection amount TAU is set under the opening control. On the other hand, in the case that the feedback condition is satisfied, a step 202 follows to check, on the basis of the variation of the intake pipe pressure, the idle switch or the like, whether the engine 10 (motor vehicle) is in the speed-decreasing state or not. If not in the speed-decreasing state, a step 203 follows to set a target air-fuel ratio $\lambda_{TG}$. Here, the target air-fuel ratio is normally set to "1" (theoretical air-fuel ratio) and set to the rich side in accordance with the operating state (at the time of acceleration).

Secondly, a step 204 is executed in order to check whether the previous feedback condition is not satisfied so that the open control is effected, that is, check whether the open control decision flag F1, which will be described hereinafter, is "1". When the opening control decision flag F1 is "1", that is, when the open control has been effected at the previous time, a step 206 follows to set the optimal feedback gain to a predetermined $IK_N$(1, 2, 3, 4, A), then followed by a step 207 to set a decision flag F2 to "0" by the feedback gain. A step 208 is executed so as to calculate the initial value $ZI_{IN}$ of the integral term in accordance with the following equation.

$$ZI_{IN}=1+K_2+K_3+K_4-K_1\cdot\lambda(K) \tag{12}$$

where $\lambda$(K) is an air-fuel ratio.

This equation (12) is for obtaining $ZI_{IN}$ by performing the inverse calculation of a FAF equation in a step 210.

Here, the optimal feedback gain $IK_N$ is determined by attaching importance to the responsability with Q/R of the performance function J being set to 1/10. Further, since an optimal feedback gain $IK_{DC}$ which will be described hereinafter is determined by setting the Q/R of the performance function J to 1/5, the optimal feedback gain $IK_{DC}$ is lower in responsability than the optimal feedback gain $IK_N$.

In the case that the decision of the step 204 is made such that the previous control is not the open control (that is, when F1=0), a step 205 follows to check whether it is required to switch the optimal feedback gain IK, i.e., check, in accordance with the feedback gain decision flag F2, whether the previous optimal feedback gain is $IK_N$ or not. When the step 202 decides the speed-decreasing state and the optimal feedback gain is set to $IK_{DC}$ (F2 is "1"), since the present optimal feedback gain is required to be switched to $IK_N$, the step 206 is executed to set the optimal feedback gain to $IK_N$, thereafter executing the step 207 to calculate the initial value $ZI_{IN}$ of the integral term, then followed by a step 209. Further, when the decision of the step 205 is made such that the previous control is the feedback control and as well as the present optimal feedback gain the previous optimal feedback gain is IKN (F2=0), the steps 206 to 208 are jumped so that the step 205 is followed by the step 209.

In the step 209, the integral term ZI(K) is calculated in accordance with the following equation.

$$ZI(K)=ZI(K-1)+K_A\times(\lambda(K)-\lambda_{TG}) \tag{13}$$

Subsequently, a step 210 follows to calculate the air-fuel ratio correction coefficient FAF in accordance with the following equation.

$$FAF(K)=ZI(K)+K_1\cdot\lambda(K)-K_3\cdot FAF(K-2)-K_4\cdot FAF(K-3) \tag{14}$$

Thereafter, a step 211 is executed so as to set the open control decision flag F1 to "0", then terminating this routine.

On the other hand, when the decision of the step 202 is made such that the engine 10 is in the speed-decreasing state, the operational flow proceeds to a step 212 to set the target air-fuel ratio $\lambda_{TG}$. At this time, the target air-fuel ratio $\lambda_{TG}$ is set to the lean side with respect to the theoretical air-fuel ratio ($\lambda$=1). A step 213 is then executed in order to check, in accordance with the open control decision flag F1, whether the feedback condition is not satisfied but the open control is effected at the previous time. If the decision is the open control (F1=1), a step 215 follows to set the optimal feedback gain to $IK_{DC}$(1, 2, 3, 4, A). Here, $IK_{DC}$ is set to a value whereby the response velocity is lower as compared with $IK_N$.

The feedback gain decision flag F2 is set to "1" in a step 216 and the initial value of the integral term is then set in the above-described step 208, thereafter followed by the steps 209 and 210 to calculate the air-fuel ratio correction coefficient FAF.

On the other hand, when the decision of the step 213 is no open control (F1=0), a step 214 is executed so as to check, in accordance with the feedback gain decision flag F2, whether the previous optimal feedback gain is $IK_{DC}$. In the case of no speed-decreasing state and the present optimal feedback gain being set to $IK_N$(F2=0), the step 215 is executed to switch and set the optimal feedback gain to $IK_{DC}$. Thereafter, in the step 216, the feedback gain decision flag F2 is set to "1" and in the step 208 the initial value of the integral term is calculated, then followed by the above-described steps 209 and 210 to calculate the air-fuel ratio correction coefficient FAF. Further, in the case that in the step 214 the speed-decreasing state is taken at the previous time and the optimal feedback gain is set to $IK_{DC}$ (F2=1), the operational flow jumps the steps 215, 216 and 208 to directly advance to the steps 209 and 210 to calculate the air-fuel ratio correction coefficient FAF, then terminating this routine.

Figure 5:
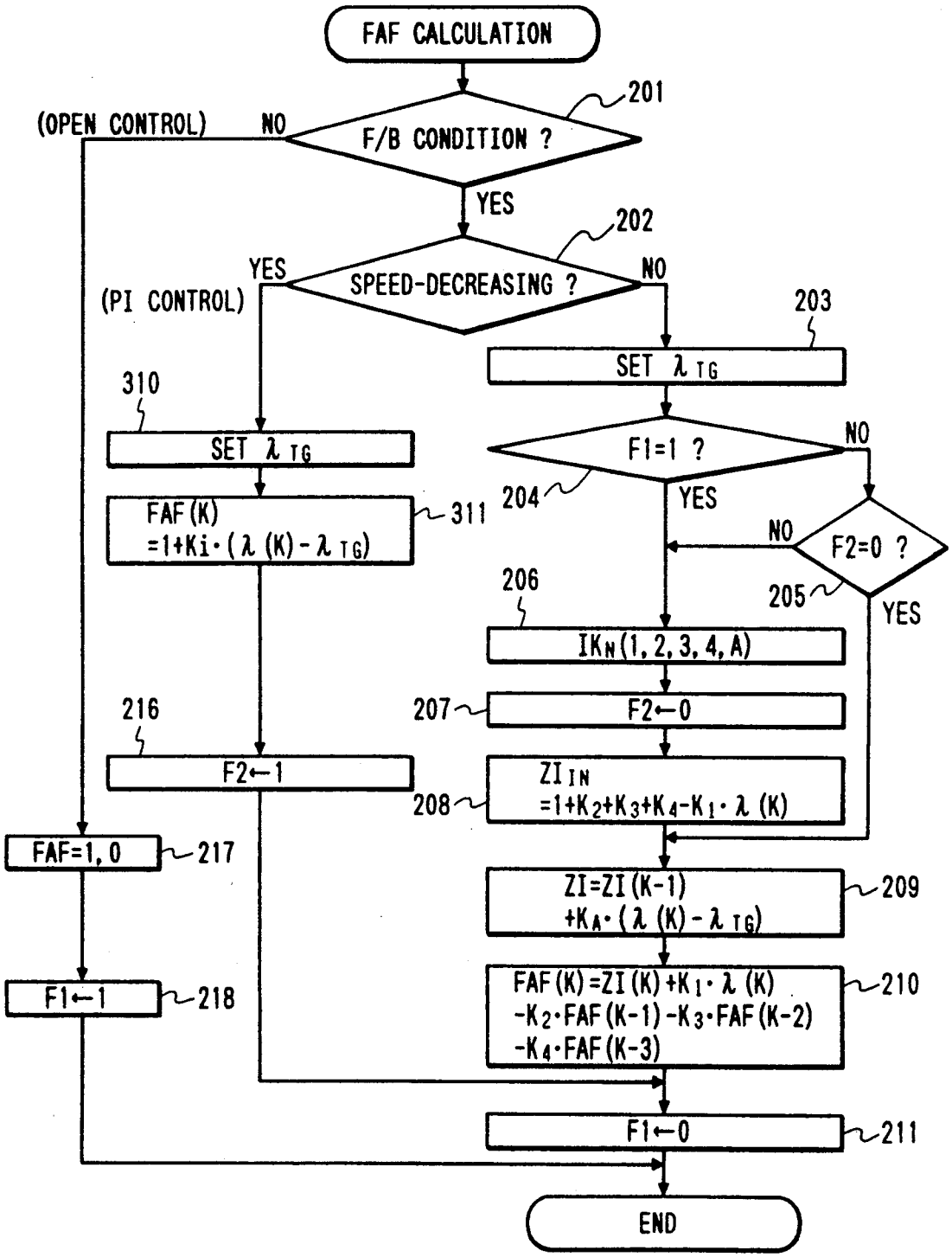
FIG. 5 is a flow chart for describing an operation of an air-fuel ratio control apparatus according to a second embodiment of this invention.
Figure 6:
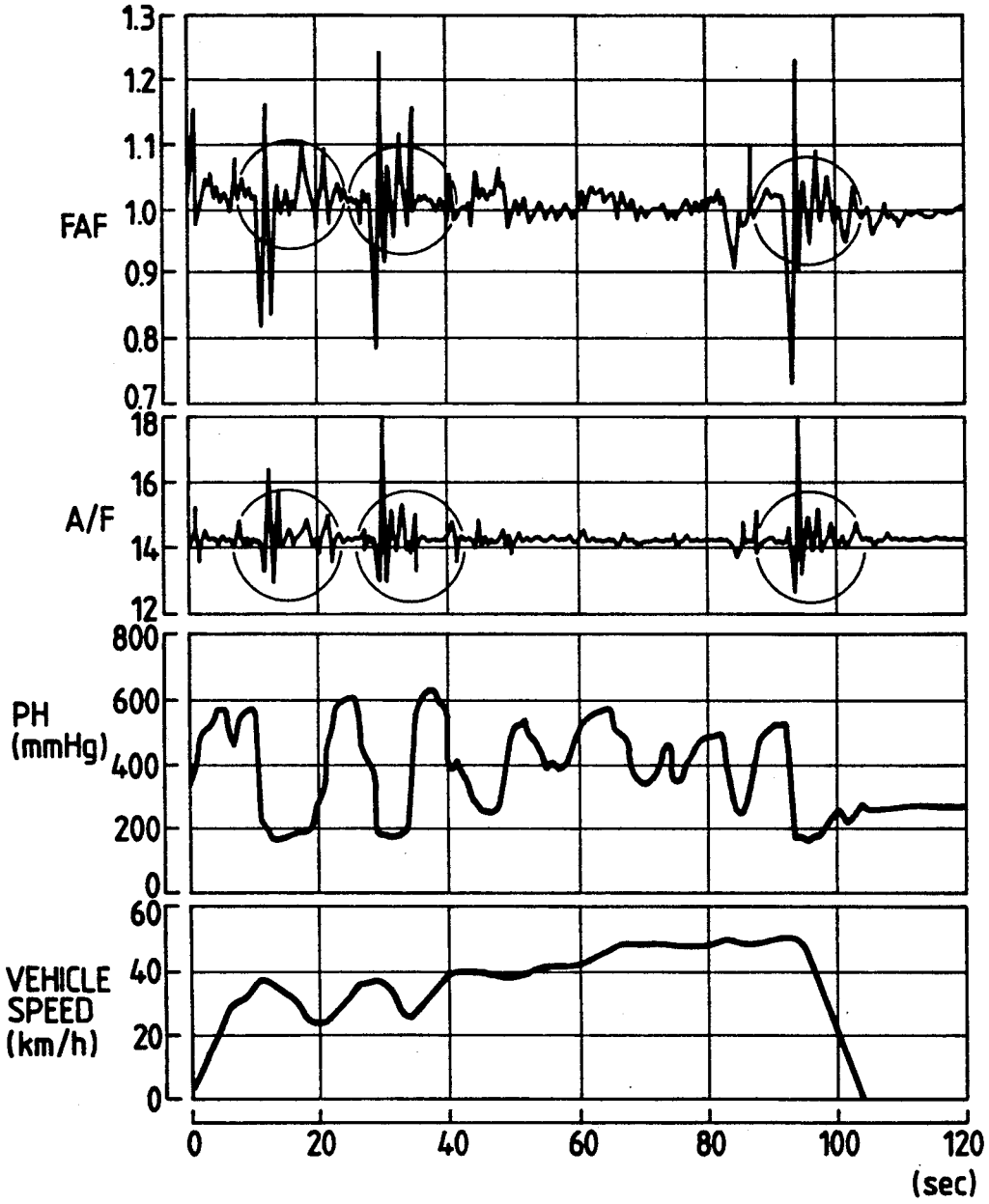
FIG. 6 is a graphic illustration useful for describing a prior art air-fuel ratio control apparatus.

Another embodiment of this invention will be described hereinbelow with reference to a flow chart of FIG. 5 where the calculation method of the air-fuel ratio correction coefficient FAF is different from the above-described embodiment. The calculation method (steps 201 to 211) of the air-fuel ratio correction coefficient FAF in the case of no speed-decreasing state and no satisfaction of the feedback condition is the same as in the above-described embodiment and the description thereof will be omitted for brevity. In the case of the speed-decreasing state, when the decision of the step 202 is affirmative, a step 310 follows to set the target air-fuel ratio $\lambda_{TG}$. Here, the target air-fuel ratio $\lambda_{TG}$ is set to the lean side with respect to the theoretical air-fuel ratio. Subsequently, a step 311 is executed in order to calculate the air-fuel ratio correction coefficient FAF in accordance with the following equation (so-called PI control).

$$FAF(K)=1+Ki\cdot(\lambda(K)-\lambda_{TG}) \quad (15)$$

where λ(K) represents an air-fuel ratio, Ki designates an integral constant, and $\lambda_{TG}$ is a target air-fuel ratio.

Further, in the case that the feedback condition is not satisfied, the air-fuel ratio correction coefficient FAF is set to 1 as well as in the above-described embodiment. The injection amount TAU is set using the air-fuel ratio correction coefficient FAF thus calculated.

It should be understood that the foregoing relates to only preferred embodiments of the present invention, and that it is intended to cover all changes and modifications of the embodiments of the invention herein used for the purposes of the disclosure, which do not constitute departures from the spirit and scope of the invention.

What is claimed is:

1. An air-fuel ratio control apparatus for an internal combustion engine, comprising:

air-fuel ratio detecting means for detecting an actual air-fuel ratio of a mixture to be introduced into said engine;

target air-fuel ratio setting means for setting a target air-fuel ratio of said engine;

controlled-amount calculating means for setting an optimal feedback gain on the basis of a predetermined dynamic model of said engine, and for calculating a controlled amount in accordance with said predetermined optimal feedback gain so that said actual air-fuel ratio becomes equal to said target air-fuel ratio;

fuel supply amount determining means for determining a fuel supply amount to be supplied to said engine on the basis of the calculated controlled amount;

speed-decreasing state detecting means for detecting a speed-decreasing state of said engine; and control suppressing means for suppressing a control responsiveness of said controlled-amount calculating means in response to detection of the speed-decreasing state of said engine, said control suppressing means comprising feedback gain switching means for switching said optimal feedback gain to a feedback gain with a low responsiveness.

2. An air-fuel ratio control apparatus as claimed in claim 1, wherein said fuel supply amount determining means determines said fuel supply amount on the basis of a basic supply amount of fuel to be supplied to said engine and said controlled amount calculated by said controlled-amount calculating means.

3. An air-fuel ratio control apparatus as claimed in claim 1, further comprising a target air-fuel ratio switching means for switching said target air-fuel ratio to a lean state with respect to a theoretical air-fuel ratio.

4. An air-fuel ratio control apparatus for an internal combustion engine, comprising:

air-fuel ratio detecting means for detecting an actual air-fuel ratio of a mixture to be introduced into said engine;

target air-fuel ratio setting means for setting a target air-fuel ratio of said engine;

first correction coefficient calculating means for setting a first optimal feedback gain on the basis of a predetermined dynamic model of said engine, and for calculating an air-fuel ratio correction coefficient in accordance with said set optimal feedback gain so that said actual air-fuel ratio becomes equal to said target air-fuel ratio;

speed-decreasing state detecting means for detecting a speed-decreasing state of said engine;

second correction coefficient calculating means for determining a second optimal feedback gain having a responsiveness lower than that of said first optimal feedback gain on the basis of said predetermined dynamic model in response to detection of said engine speed-decreasing state, and for calculating an air-fuel ratio correction coefficient in accordance with said second optimal feedback gain so that said actual air-fuel ratio becomes equal to said target air-fuel ratio; and fuel supply amount determining means for determining a fuel supply amount to said engine on the basis of the air-fuel correction coefficient calculated by said first or second correction coefficient calculating means.

5. An air-fuel ratio control apparatus as claimed in claim 4, further comprising target air-fuel ratio switching means for switching said target air-fuel ratio to a lean state with respect to a theoretical air-fuel ratio when said speed-decreasing state of said engine is detected.

* * * * *